US007665468B2

(12) United States Patent
Matsuura et al.

(10) Patent No.: US 7,665,468 B2
(45) Date of Patent: Feb. 23, 2010

(54) CIGARETTE MAKING MACHINE AND METHOD

(75) Inventors: Sadayoshi Matsuura, Tokyo (JP); Keisuke Minami, Tokyo (JP); Tsuyoshi Futamura, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 327 days.

(21) Appl. No.: 11/244,104

(22) Filed: Oct. 6, 2005

(65) Prior Publication Data

US 2006/0076026 A1 Apr. 13, 2006

Related U.S. Application Data

(63) Continuation of application No. PCT/JP2004/004936, filed on Apr. 6, 2004.

(30) Foreign Application Priority Data

Apr. 7, 2003 (JP) ..... 2003-103100

(51) Int. Cl.
*A24C 5/12* (2006.01)

(52) U.S. Cl. ..... 131/65; 131/58; 131/60

(58) Field of Classification Search ..... 131/84.1, 131/280, 116, 58–76
See application file for complete search history.

(56) References Cited

U.S. PATENT DOCUMENTS 4,287,754 A 9/1981 Heitmann et al.
4,367,758 A 1/1983 Seragnoli
4,619,278 A * 10/1986 Smeed et al. ..... 131/284
4,733,673 A * 3/1988 Mattei et al. ..... 131/84.1
6,020,969 A 2/2000 Struckhoff et al.
2004/0118416 A1* 6/2004 Seymour et al. ..... 131/60

FOREIGN PATENT DOCUMENTS

JP 62-83880 A 4/1987
JP 10-136960 A 5/1998
JP 2001-509366 A 7/2001
RU 200103214 C2 12/2001
SU 1039433 A3 8/1983
SU 1087049 A3 4/1984
WO WO-01/84969 A1 11/2001
WO WO 02/091865 * 11/2002

* cited by examiner

*Primary Examiner*—Steven P Griffin
*Assistant Examiner*—Jodi Cohen
(74) *Attorney, Agent, or Firm*—Birch, Stewart, Kolasch & Birch, LLP

(57) ABSTRACT

A cigarette making machine includes a web roll (8) from which a web W having bands previously formed is drawn, and a suction brake (14) arranged between the web roll (8) and a garniture tape (2) of a wrapping section (6). When a band (B) for a cigarette (C) is out of a proper region (CR), the suction brake increases the tension to be applied to the web W to elongate the web to thereby bring the location of each band (b) back to within the proper region.

11 Claims, 7 Drawing Sheets

CIGARETTE MAKING MACHINE AND METHOD

This application is a Continuation of copending PCT International Application No. PCT/JP2004/004936 filed on Apr. 6, 2004, which designated the United States, and on which priority is claimed under 35 U.S.C. § 120. This application also claims priority under 35 U.S.C. 119(a) on Patent Application No(s). 2003-103100 filed in Japan on Apr. 7, 2003. The entire contents of each of the above documents is hereby incorporated by reference.

TECHNICAL FIELD

This invention relates to a cigarette making machine and method for making cigarettes with a special property imparted.

BACKGROUND ART

In recent years, various cigarettes with a desired property imparted are known. The wrapping paper of such cigarettes has a band for imparting a property, and the band is formed by applying one of materials, which vary in the property to be imparted, onto the wrapping paper.

For example, a cigarette disclosed in PCT Application Published Japanese Translation No. 2001-509366 has a low ignition propensity, and this low ignition propensity is imparted by a plurality of bands. The bands are formed on the wrapping paper, at predetermined intervals along the axial direction of the cigarette.

A cigarette disclosed in the pamphlet of International Publication No. 01/84969 has a property of improving burning by suppressing the production of an undesired substance or aldehyde at the time of ignition. This burning-improvement property is imparted by a single band. Specifically, the single band is formed on the wrapping paper to be located at the distal end (ignition end) of the cigarette.

Further, a cigarette may have a band for improving the taste and flavor thereof, and such band is also formed on the wrapping paper.

In order for a cigarette as mentioned above to fully show its property, it is desirable that a band be formed on the wrapping paper accurately. Particularly in the case of the cigarette disclosed in the above-mentioned pamphlet, unless the band is accurately located at the distal end of the cigarette, the band cannot impart the desired burning-improvement property.

However, in making cigarettes of this type, it is very difficult to locate the band accurately at the distal end of a cigarette. Specifically, the common cigarette making machine comprises a garniture tape for making a web of wrapping paper travel at a fixed speed, a wrapping section, and a cutting section. While passing through the wrapping section, cut tobacco on the traveling web is continuously wrapped in the web, and the wrapping section continuously delivers a resultant tobacco rod to the cutting section. Then, while passing through the cutting section, the tobacco rod is cut to a predetermined length, so that individual cigarettes are obtained.

If the bands are formed on the web at predetermined intervals in advance, and the garniture tape and the web are made to travel in an integrated manner, the common cigarette making machine can make cigarettes having an above-mention band, accurately.

While the tobacco rod is being formed, however, if a slip occurs between the web and the garniture tape, no matter how slight the slip is, the slip causes a band for a cigarette to displace from its desired position, so that the band cannot be accurately located at the distal end of a cigarette.

In order to obviate this problem, it is thinkable, in the cigarette making machine, to relatively change the traveling speed of the garniture tape with respect to the timing of cutting the tobacco rod, or in other words, change the advance phase of each band in traveling relative to the timing of cutting the tobacco rod.

However, in the cigarette making machine, high-speed and stable manufacturing of cigarettes is ensured by keeping the traveling speed of the garniture tape and the timing of cutting the tobacco rod constant. Therefore, it is not realistic to relatively change the traveling speed of the garniture tape or with respect to the timing of cutting the tobacco rod as mentioned above.

DISCLOSURE OF THE INVENTION

This invention has been made considering the above circumstances. An object of the invention is to provide a cigarette making machine and method that can make cigarettes with a band accurately at a desired position, without relatively changing the traveling speed of the garniture tape with respect to the timing of cutting the tobacco rod.

In order to achieve the above object, a cigarette making machine according to this invention further comprises change means for changing the location of each band relative to a cigarette while the relation between the traveling speed of the garniture tape and the timing of cutting the tobacco rod constant, wherein the change means includes a brake arranged in a web feeding path, for adjusting tensity of the web by exerting a braking force on the web, and a positioning device for controlling the brake on the basis of the elongation of the web caused by the tensity of the web and thereby bringing the location of each band relative to a cigarette in a proper region.

Specifically, the positioning device can include a band detector arranged between the brake and the wrapping section for detecting the band on the web and sending out a detection signal, a signal generator arranged in the cutting section for sending out a cutting signal at the time the tobacco rod is cut, a determination circuit for determining whether or not the band is located in the proper region on the basis of the detection signal and the cutting signal, and a control circuit for adjusting the tensity of the web, by means of the brake on the basis of the result of the determination by the determination circuit and thereby controlling the elongation of the web to locate the band in the proper region.

According to the change device, when the band is out of the proper region for the cigarette in one direction, specifically, upstream side (in the delay side), as viewed in the direction of traveling of the tobacco rod, the control circuit adjusts the tensity of the web, by means of the brake and thereby controls the elongation of the web. Specifically, the tensity of the web is increased, so that the web is elongated correspondingly, so that the distance between the bands on the web is increased. Consequently, the position of each band is gradually displaced downstream side, as viewed in the direction of traveling of the tobacco rod, or in other words, the advance side with respect to the timing of cutting the tobacco rod, and returns to the proper region for a cigarette.

Thus, the change device can bring the location of the band for a cigarette to within the proper region, while the relation between the traveling speed of the garniture tape and the timing of cutting the tobacco rod is kept constant.

Specifically, the proper region has a predetermined length from an ignition end of the cigarette, and the brake applies tension to the web in the range of 5 to 15 N per width.

When the tensity of the web is in the above range, the web is stretched by elongation proportional to the tension applied to the web, without breaking. Consequently, each band is positioned accurately.

The brake can include a suction brake for exerting a suction force on the web or a brake roller unit for feeding the web in cooperation with the garniture tape. The suction brake or the brake roller unit can easily apply tensity to the web, and the magnitude of the tensity of the web can be easily adjusted.

When a band located out of the proper region is detected, the control circuit increases the tensity of the web by means of the brake. In this case, the position of a band is changed by a distance corresponding to the length of one cigarette at most, until location of the band returns to the proper region.

Meanwhile, when a band located out of an allowable region including the proper region is detected, the control circuit can output a removal signal for removing a cigarette having the band. Further, when the band detector does not detect a band, the control circuit can output a removal signal for removing a cigarette having no band. In this case, defective cigarettes are removed with certainty.

Desirably, the brake previously applies tension to the web, for causing predetermined elongation of the web. In this case, the control circuit increases or decreases the tensity of the web, by means of the brake on the basis of the result of the determination by the determination circuit. Consequently, the elongation of the web is increased or decreased. In this case, no matter in which direction the location of a band is out of the proper region, then the location of a band can be quickly brought to within the proper region by adjusting the tensity of the web.

The above-mentioned object can be achieved also by a cigarette making method according to the present invention. This method further comprises a step of changing the location of a band relative to a cigarette while the relation between the traveling speed of the garniture tape and the timing of cutting the tobacco rod is kept constant, and this step includes applying tension to the web, and controlling the elongation of the web caused by the tension and thereby bringing the location of a band relative to a cigarette in a proper region.

BEST MODE FOR CARRYING OUT THE INVENTION

Figure 1:
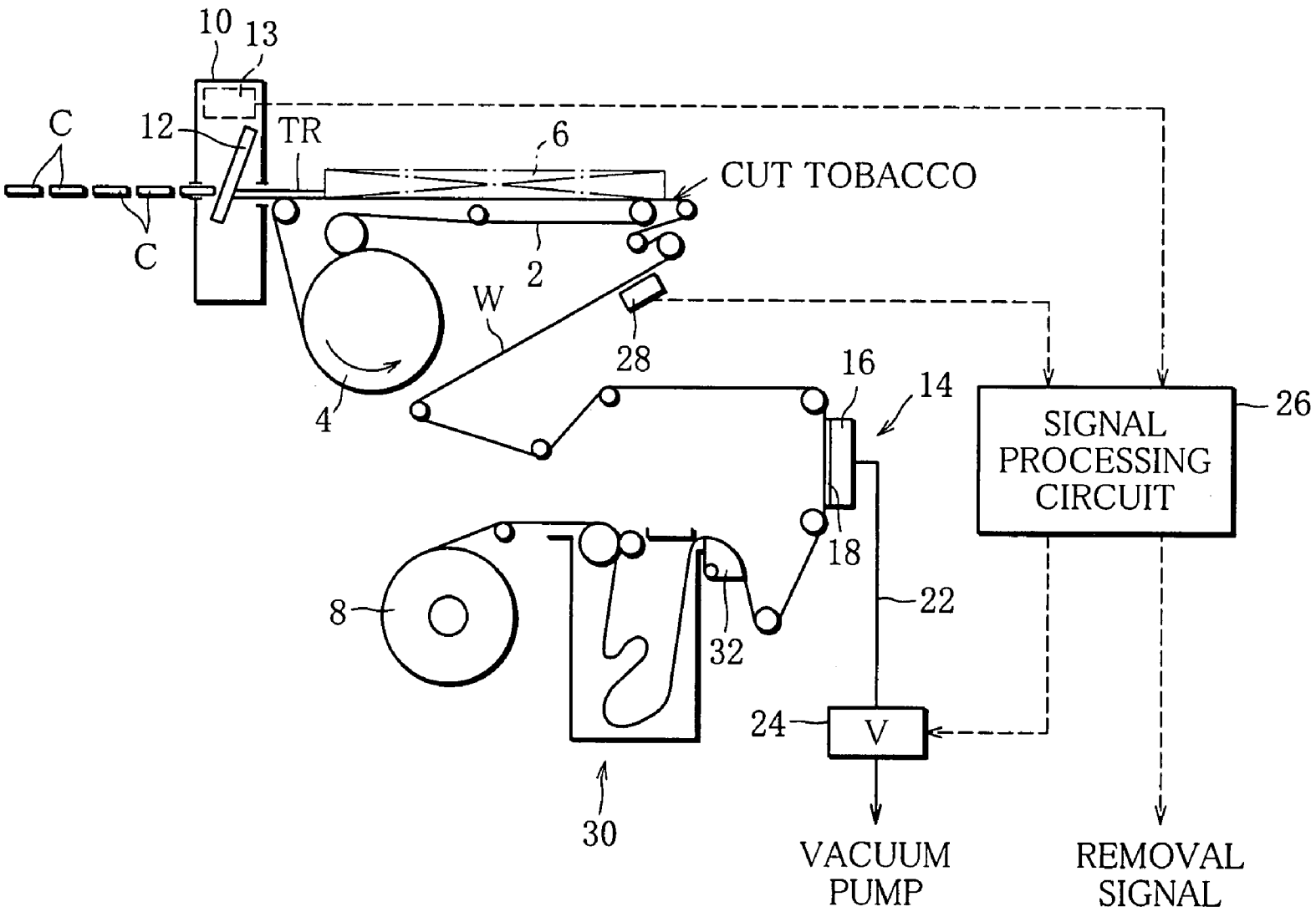
FIG. 1 is a diagram schematically showing part of a cigarette making machine.

A cigarette making machine shown in FIG. 1 has an endless garniture tape 2. The garniture tape 2 is made to travel in one direction by the rotation of a drive drum 4, and passes through a wrapping section 6.

The garniture tape 2 receives a web W of cigarette wrapping paper and a layer of cut tobacco, in the upstream side of the wrapping section 6, as viewed in the direction of traveling of the garniture tape 2. The web W is drawn from a web roll 8 and guided onto the garniture tape 2, and the layer of cut tobacco is supplied onto the web W from a tobacco band (not shown).

The web W passes through the wrapping section 6 with the garniture tape 2, during which, the wrapping section 6 continuously wraps the cut tobacco in the web W and thereby forms a tobacco rod TR. The tobacco rod TR formed is delivered from the wrapping section 6.

Downstream of the wrapping section 6 is arranged a cutting section 10. The cutting section 10 has a rotatable cutting knife 12. When the tobacco rod TR delivered from the wrapping section 6 passes though the cutting section 10, the tobacco rod TR is cut into individual cigarettes C of a predetermined length by the rotation of the cutting knife 12. The cutting section 10 also includes a signal generator 13 which generates a cutting signal indicating the timing of cutting when the tobacco rod TR is cut.

On the web W, bands are previously formed at predetermined intervals. In the present embodiment, the interval between the bands corresponds to the length of one cigarette C. For example, the bands are formed by applying onto the back surface of the web W a reducing agent for reducing the amount of aldehyde produced when the cigarette is ignited. As the reducer, a reducing agent disclosed in the above-mentioned International Publication No. 01/84969 can be used.

Figure 2:
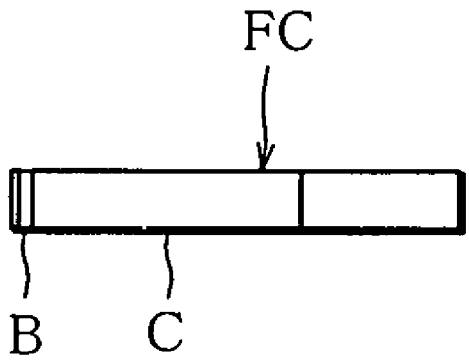
FIG. 2 is a filter cigarette made by the machine shown in FIG. 1.

The phase of the cutting knife 12 in its rotation or the timing of cutting the tobacco rod TR is determined depending on the traveling speed of the garniture tape 2 or the advance phase of each band in traveling. Consequently, individual cigarettes C can have a band in a proper region. The proper region is defined by a cut end of a cigarette C and a position a predetermined distance upstream from the cut end, as viewed in the direction of traveling of the tobacco rod TR. Afterwards, when a filter cigarette FC having a cigarette C and a filter is formed, the band B comes to the ignition end of the filter cigarette FC as shown in FIG. 2.

As shown in FIG. 1, a web W supply path extends from the web roll 8 to the garniture tape 2, and a suction brake 14 is arranged in the supply path.

Figure 3:
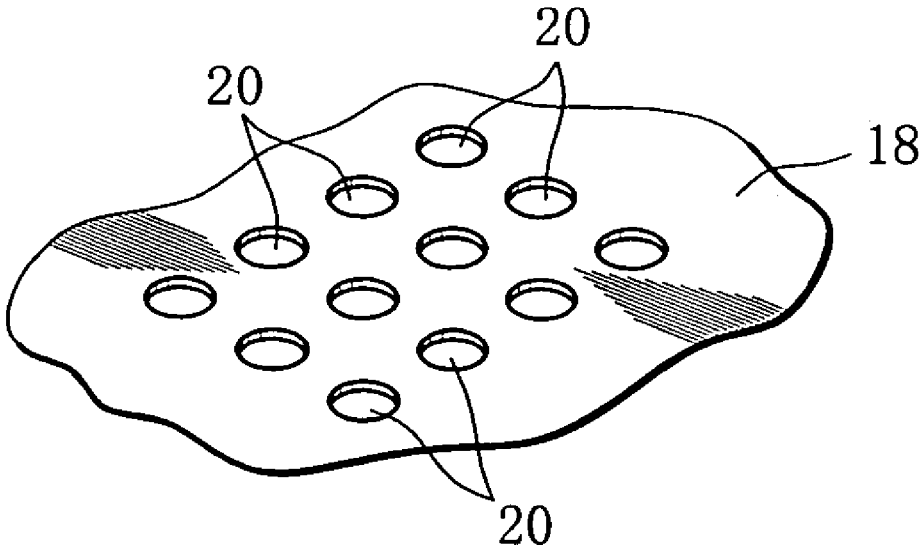
FIG. 3 is a diagram showing part of a suction brake shown in FIG. 1.

The suction brake 14 includes a suction box 16, and the suction box 16 has a suction surface facing to the supply path, or in other words, the web W. The suction surface is formed of a perforated plate 18 shown in FIG. 3, and the perforated plate 18 has a large number of suction holes 20. The suction holes 20 are uniformly distributed over the entire suction surface.

From the suction box 16 extends a suction pipe 22. The suction pipe 22 is connected with a vacuum pump. In the suction pipe 22 is inserted a pressure control valve 24. The pressure control valve 24 is electrically connected with a signal processing circuit 26. When a valve opening signal is supplied from the signal processing circuit 26 to the pressure control valve 26, the pressure control valve 24 is opened to adjust and supply the suction pressure of the vacuum pump to the suction box 16. Consequently, the suction brake 14 sucks air through the suction holes 20 of the perforated plate 18, so that the web W is sucked onto the suction surface, or the perforated plate 18.

The suction force of the suction brake 14 is smaller than the traction force which the garniture tape 2 exerts on the web W, so that the web W is supplied to the wrapping section 6, resisting the suction force exerted by the suction brake 14. Thus, between the garniture tape 2 and the suction brake 14, the web W is pulled by the traction force exerted by the garniture tape 2. By this, the tensity of the web W is increased and the web W is elongated along its longitudinal direction by an amount corresponding to the increase in the tension applied to the web.

Figure 4:
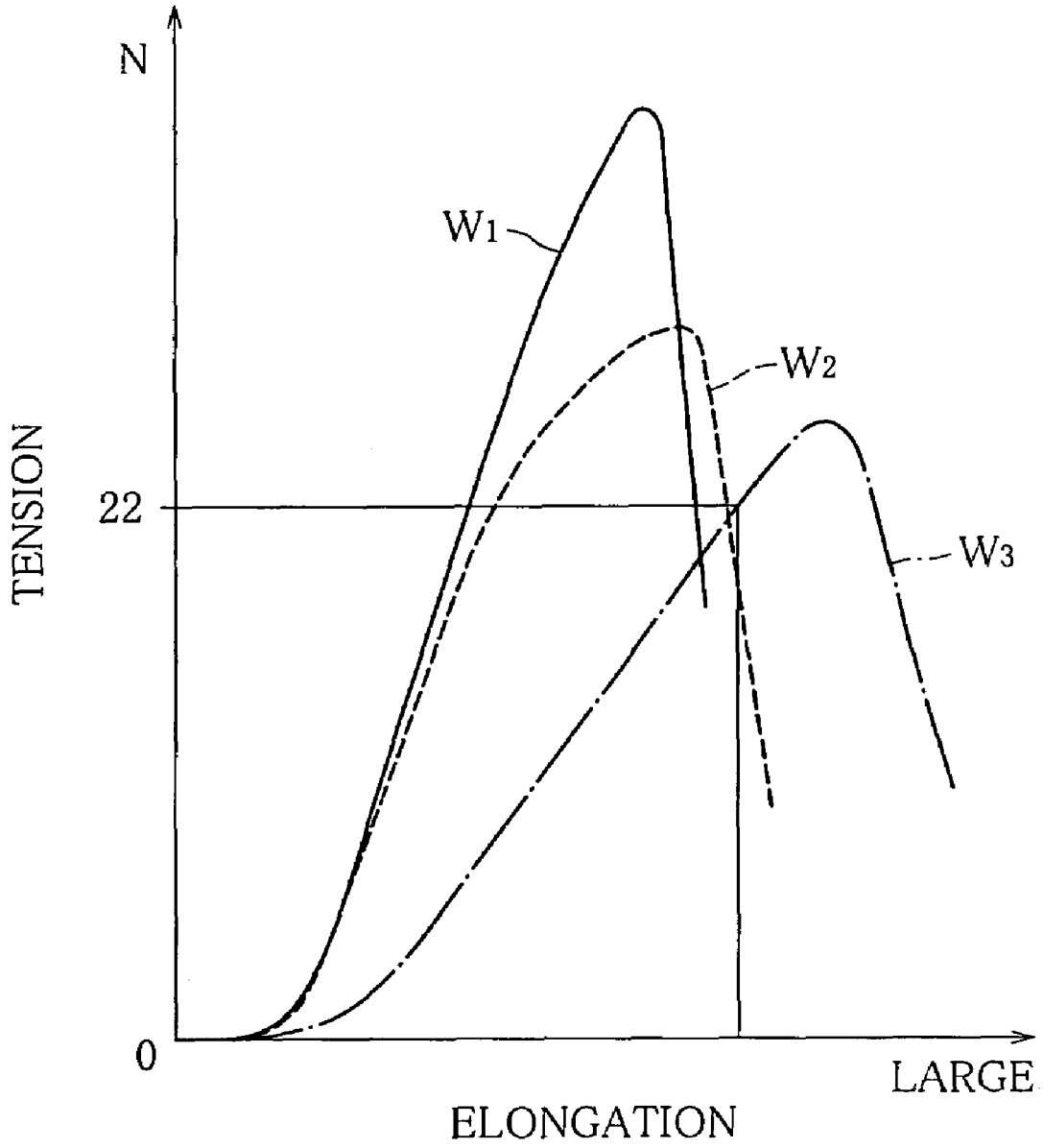
FIG. 4 is a graph showing relation between tension and elongation for a web of wrapping paper.

FIG. 4 shows the tension-elongation characteristic for three webs $W_1$, $W_2$ and $W_3$ which are different in air permeability. These characteristic curves are obtained from measurement. As clear from FIG. 4, in any of the webs, the elongation of the web increases in proportion to the tension applied to the web, when the tension applied to the web is in the range of 1 to 22 N per width H of the web W (27 mm), desirably in the range of 5 to 15 N per width H. When the tension of the web W is controlled in the range of 5 to 15 N per width H, therefore, the web W can be stretched by desired elongation, without breaking.

A tensile test showed that when the tension applied to the webs $W_1$ to $W_3$ is in the above-mentioned range, the webs $W_1$ to $W_3$ were elongated by 0.02 to 0.03% per 1 N.

Between the suction brake 14 and the garniture tape 2 in the supply path of the web W, a band detector 28 is arranged. The band detector 28 is electrically connected with the signal processing circuit 26. As the band detector 28, an optical sensor as disclosed in the above-mentioned PCT Application Published Japanese Translation No. 2001-509366 can be used.

When each of the bands B on the web W passes through the band detector 28, the band detector 28 detects the passing band B and outputs a band signal indicating the detection of the band to the signal processing circuit 26.

The signal processing circuit 26 is electrically connected also with the cutting section 10, and the cutting section 10 outputs the cutting signal of the tobacco rod TR to the signal processing circuit 26.

Figure 5:
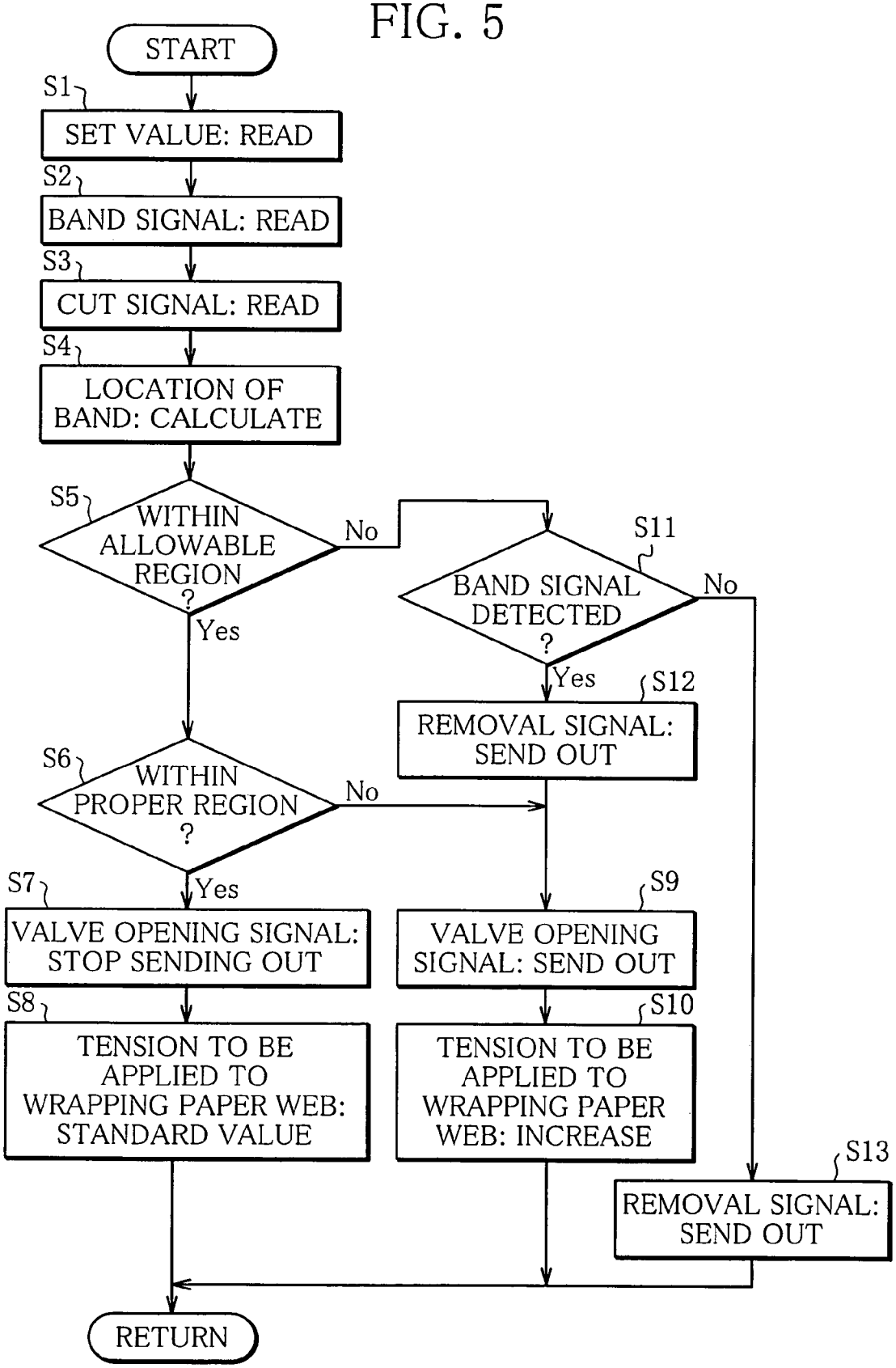
FIG. 5 is a flow chart showing a control routine for controlling the elongation of the web depending on the position of a band on the web.

The signal processing circuit 26 controls the supply of the valve opening signal to the pressure control valve 24, according a control routine shown in FIG. 5.

Control Routine

Suppose that during the operation of the cigarette making machine, the relation between the traveling speed of the garniture tape (the advance phase of each band in traveling) and the cutting timing of the tobacco rod TR (the cutting phase of the cutting knife 12 in its rotation) are kept constant. Further, suppose that in the initial state, the band B of each cigarette C made by the cigarette making machine is located in the above-mentioned proper region.

In these operation conditions of the cigarette making machine, the signal processing circuit 26 first reads predetermined set values (step S1). The set values include the type of the web, the tension to be applied to the web W, the standard tension for the web W, etc.

Next, the signal processing circuit 26 reads the band signal and the cutting signal successively (steps S2 and S3), and on the basis of the band signal and the cutting signal, the distance between the cut end of the tobacco rod TR and the next band B, namely the location of the band B relative to the front end of a to-be-formed cigarette C is calculated in the signal processing circuit 26 (step S4).

Needless to say, when the location of the band B is calculated, the distance between the band detector 28 and the cutting section 10, the traveling speed of the web W or the garniture tape 2, the rotational speed of the cutting knife 12, etc. are considered in the signal processing circuit 26.

Then, whether or not the location of the band B is within an allowable region AR is determined (step S5). When the result of the determination is Yes, then, whether or not the location of the band B is within a proper region CR is determined (step S6).

Figure 6:
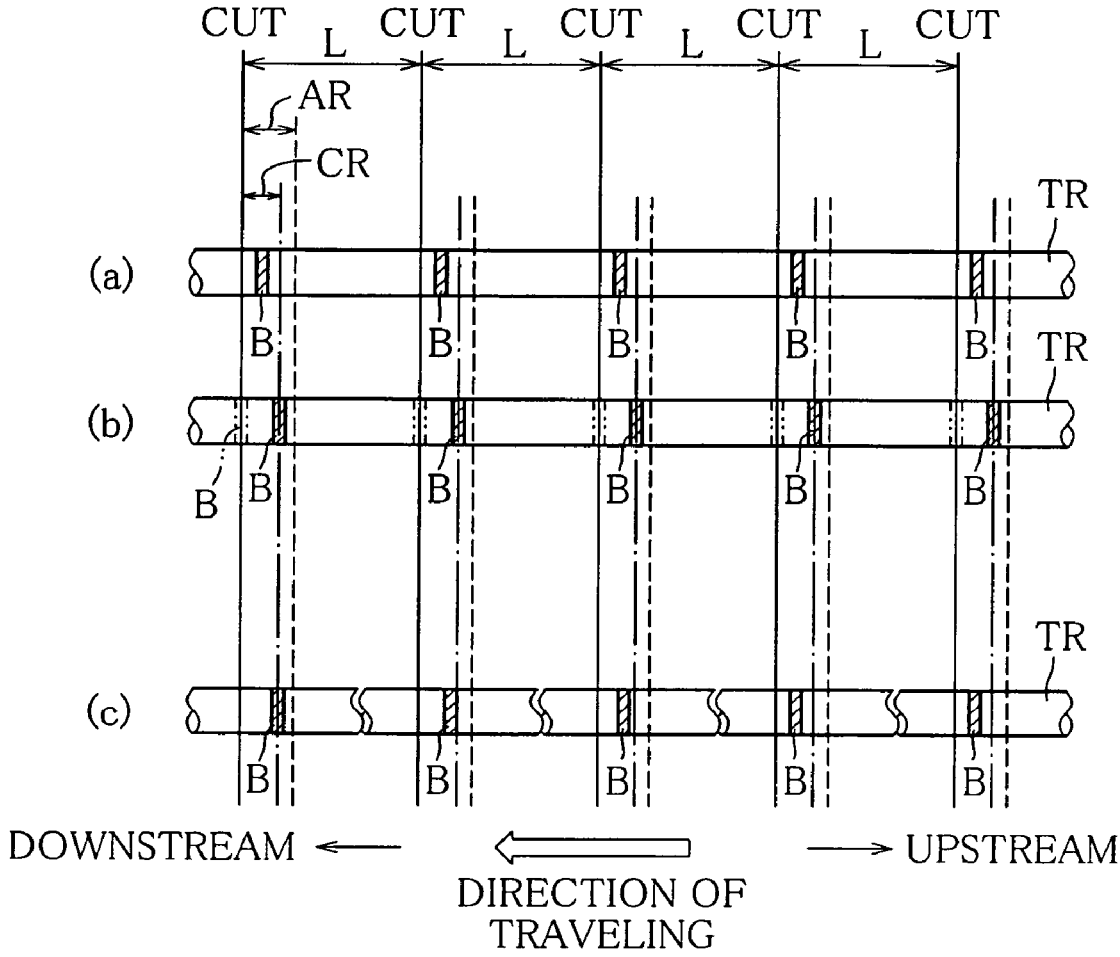
FIG. 6 is a diagram showing the positions of bands relative to allowable regions and to proper regions.

As shown in FIG. 6, the allowable region AR is defined by the cutting position of the tobacco rod TR and a limit position which is a predetermined distance backward from the cutting position, as viewed in the direction of traveling of the tobacco rod TR. The proper region CR is defined within the allowable region AR. Specifically, the proper region CR is defined by the cutting position and a downstream position of the limit position. In FIG. 6, reference sign L indicates the length of one cigarette C.

When the result of the determination in step S5 and that in step S6 are both Yes, the supply of the valve opening signal from the signal processing circuit 26 to the pressure control valve 24 is stopped (step S7) and the tension to be applied to the web W is kept at the standard value (step S8).

This situation is shown in FIG. 6 (*a*), where each band B is located within the proper region CR.

Meanwhile, as a situation in which the result of the determination in step S6 is No, for example, there is a case where the location of each band B is within the allowable region AR but out of the proper region CR to the upstream side, as shown in FIG. 6(B). In this case, the signal processing circuit 26 outputs the valve opening signal to open the pressure control valve 24 (step S9). Consequently, the suction pressure is supplied from the pressure control valve 24 to the suction brake 14, so that the suction brake 14 sucks the web W and thereby increases the tension of the web W (step S10).

When the tension of the web W is increased like this, the web W is elongated, so that the position of each band B gradually changes the downstream side (in the advance side), as viewed in the direction of traveling of the tobacco rod TR or toward the proper region CR, so that each band B comes back to within the proper region CR as shown in FIG. 6(C).

After this, when the result of the determination in step S6 changes to Yes, the signal processing circuit 26 stops the output of the valve opening signal (step S7), so that the pressure control valve 24 is closed to bring the tension to be applied to the web W back to the standard value (step S8).

Meanwhile, when the location of a band B is out of the allowable region AR to the upstream side, so that the result of the determination in step S5 is No, whether or not the band signal has been output, or in other words, whether or not the band has been detected is determined (step S11). If the result of the determination here is Yes, the signal processing circuit 26 sends out a removal signal to remove a cigarette C with a band at an unacceptable location (step S12), and then the above-mentioned steps S9 and S10 are performed. Steps S9 and S10 are repeated until the location of each band B comes back to within the proper region CR due to the elongation of the web B increased by increase in the tension of the web W.

When the result of the determination in step S11 is No, the signal processing circuit 26 sends out a removal signal (step S13).

In the above description, when the location of a band B is out of the proper region CR or the allowable region AR to the upstream side, the result of the determination in step S5 is No. Consequently, the tension of the web W or the elongation of the web W is increased, so that the location of each band B comes back to within the proper region CR.

However, also when the position of a band B is out of the proper region CR and the allowable region AR to the downstream side, as indicated by the chain double-dashed line in FIG. 6(B), the result of the determination in step S5 is No. Also in this case, steps S9 and S10 are performed in the same way. Consequently, the web W continues to be elongated with the increase in the tension of the web W, so that the location of each band B is brought back to within the proper region CR. In this case, the position of each band B is displaced toward the downstream side (in the advance side) by a distance corresponding to the length of one cigarette C.

The present invention is not limited to the above-described embodiment but can be modified in various ways.

For example, when the cigarette making machine is in steady operation, the suction brake 14 can constantly apply to the web W specific high tension higher the above-mentioned standard value. In this case, the web W is stretched by elongation corresponding to the high tension. In this situation, when the tension of the web W is increased or decreased, the elongation of the web W is increased or decreased, respectively. This means that the elongation of the web W can be controlled both in the increasing direction and in the decreasing direction.

Figure 7:
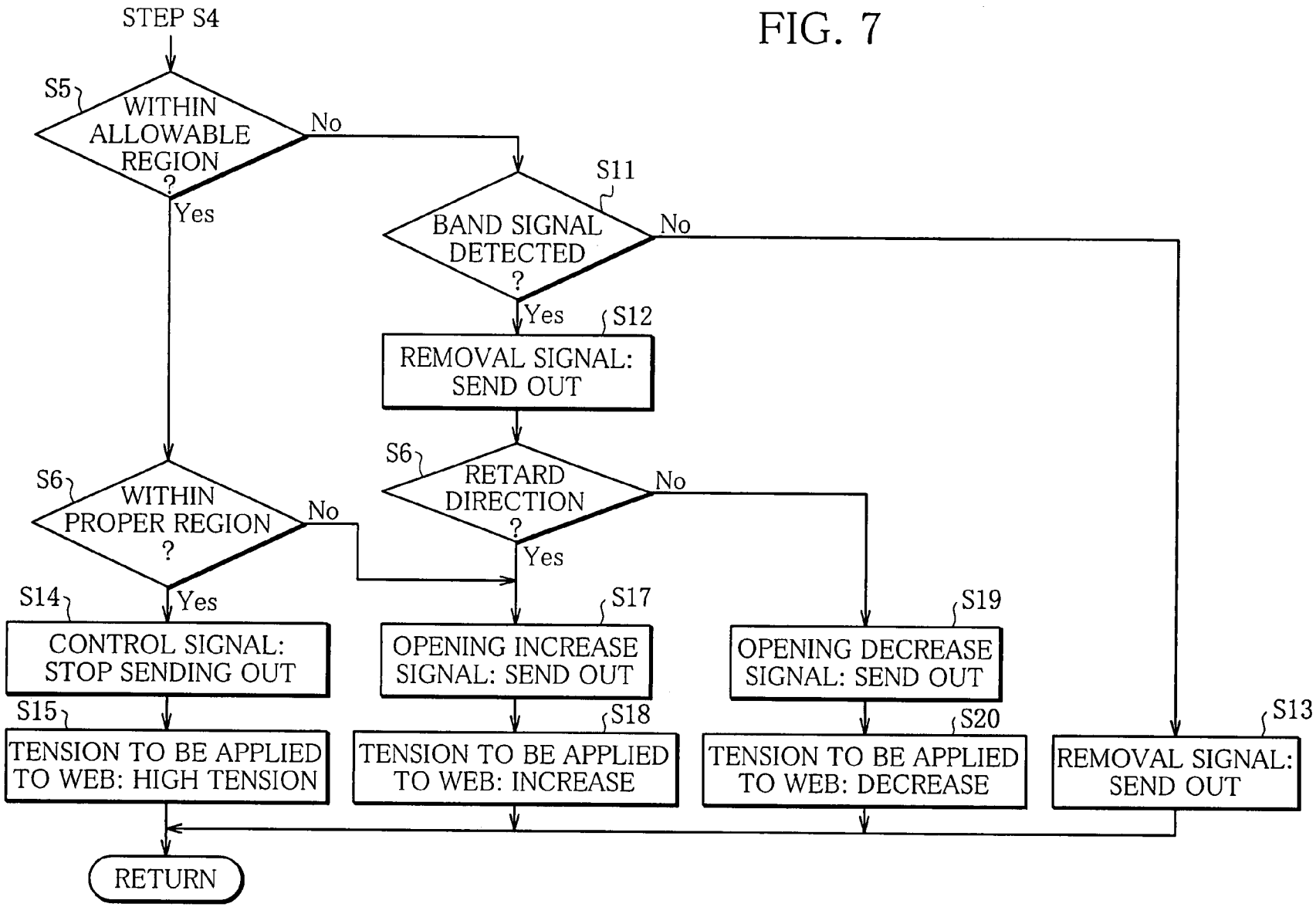
FIG. 7 is a flow chart showing part of a control routine in a modified example.

In this case, the signal processing circuit 26 controls the opening of the pressure control valve 24 or the suction force of the suction brake 14 according to a control routine shown in FIG. 7.

In the control routine in FIG. 7, the steps preceding step S5 are identical to steps S1 to S4 in the control routine shown in FIG. 5. Hence, steps S1 to S4 are omitted in FIG. 7.

In the control routine shown in FIG. 7, when the result of the determination in step S6 is Yes, the signal processing circuit 26 stops sending out the control signal to the pressure control valve 24 (step S14). Consequently, the opening of the pressure control valve 24 is kept at a predetermined value, so that the above-mentioned high tension is applied to the web W by the suction brake 14 (step S15).

Meanwhile, when the result of the determination in step S5 is No and the result of the determination in step S11 is Yes, the signal processing circuit 26 sends out the removal signal (step S12), and then determines in which direction the location of the band B is out of the allowable region AR, more specifically, whether or not the band B is displaced from the proper position to the upstream side, namely the delay side (step S16).

When the result of the determination in step S16 is Yes, the signal processing circuit 26 sends out an opening increase signal to the pressure control valve 24 (step S17) to increase the opening of the pressure control valve 24. Consequently, the tension of the web W is increased to a value greater than the above-mentioned high tension, so that the location of each band B is displaced in the advance side and comes back to within the allowable region AR, and then within the proper region CR.

Meanwhile, the result of the determination in step S16 is No, the signal processing circuit 26 sends out an opening decrease signal to the pressure control valve 24 (step S19) to decrease the opening of the pressure control valve 24. Consequently, the tension of the web W is decreased to a value smaller than the above-mentioned high tension, so that the location of each band B is displaced in the delay side and comes back to within the allowable region AR, and then within the proper region CR.

When the location of each band B can be displaced also in the delay side like this, even if the location of each band B is out of the allowable region AR to the advance side, the location of each band B can be quickly brought back to within the proper region CR. Consequently, the number of times that the removal signal is sent out is decreased, which means that the number of cigarettes C removed as defective cigarettes is decreased.

When the cigarette making machine includes a web W reservoir 30 downstream of the web roll 8 as shown in FIG. 1, the reservoir 30 can be used instead of the suction brake 14.

As publicly known, the reservoir 30 is used to replace a roll 8 in use from which a web W is being drawn with a standby roll (not shown). By the reservoir 30, the web from the standby roll can be automatically connected with the web W from the roll in use.

Normally, the reservoir 30 has a suction guide 32 at the outlet thereof. The suction guide 32 has a guide surface for restricting the meandering of the web W, and the guide surface functions as a suction surface similar to the suction surface of the suction brake 14. When the suction guide 32 is connected with the vacuum pump by the suction pipe 22 with the pressure control valve 24 inserted, therefore, the suction guide 32 can control the tension to be applied to the web W.

Figure 8:
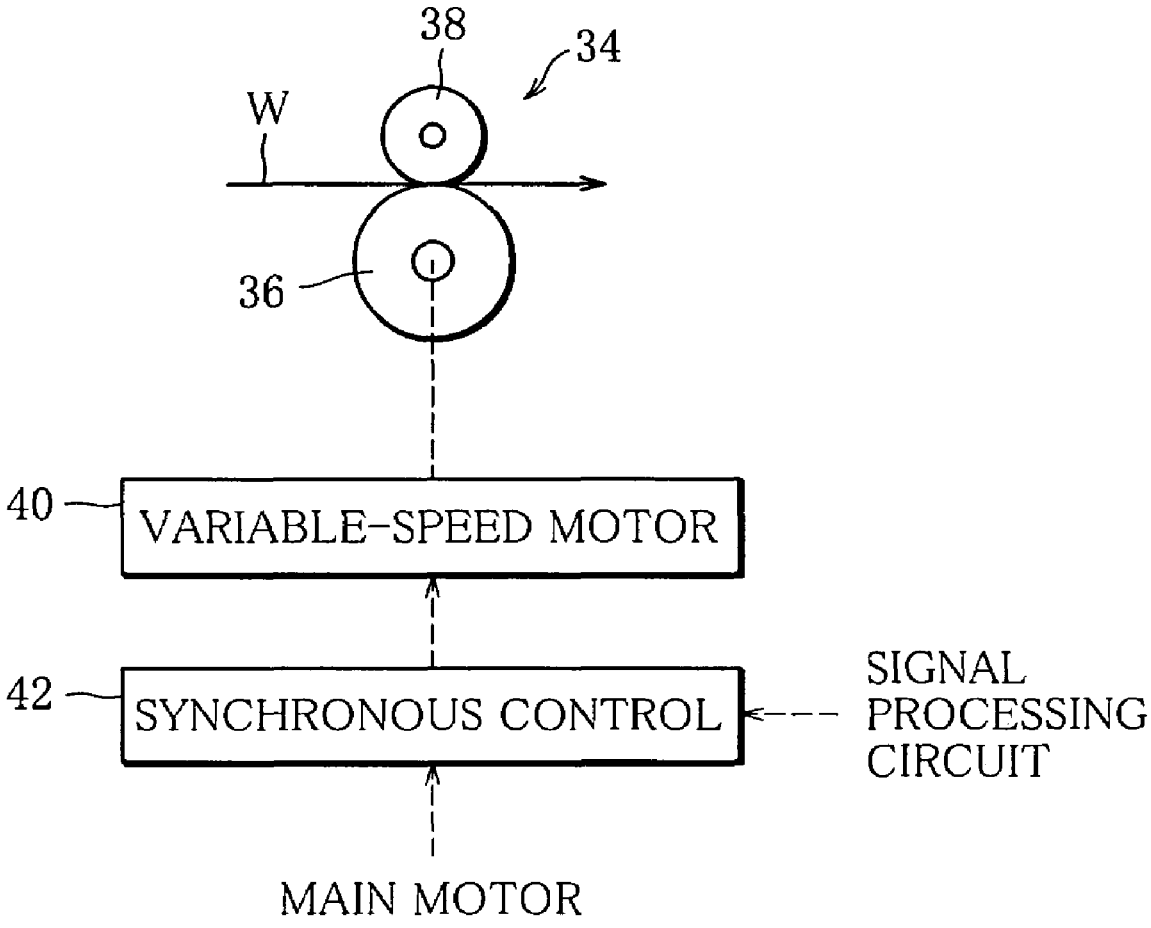
FIG. 8 is a diagram showing a feed roller unit.

Further, a brake roller unit 34 as shown in FIG. 8 can be used to control the tension of the web W.

The brake roller unit 34 is arranged in the supply path of web W, and comprises a brake roller 36 and a pinch roller 38. The web W is pinched between the brake roller 36 and the pinch roller 38, and made to travel with rotation of the brake roller 38. The brake roller 38 is rotated by a variable-speed motor 40, and the variable-speed motor 40 is electrically connected with a synchronous control circuit 42.

The synchronous control circuit 42 is electrically connected with a main motor (not shown) for driving the drive drum 4 for the garniture tape 2 and with the signal processing circuit 26. In this case, the signal processing circuit 26 supplies a deceleration signal and an acceleration signal, which correspond to the above-mentioned opening increase signal and opening decrease signal, respectively, to the synchronous control circuit 42.

When the cigarette making machine is in steady operation and neither the deceleration signal nor the acceleration signal is supplied to the synchronous control circuit 42, the synchronous control circuit 42 controls the variable-speed motor 40 to rotate the brake roller 36 at a peripheral speed equal to or lower than the peripheral speed of the drive drum 4. In this case, the brake roller unit 34 applies the above-mentioned standard tension or high tension to the web W.

In this state, when the deceleration signal or the acceleration signal is supplied from the signal processing circuit 26 to the synchronous control circuit 42, the synchronous control circuit 42 controls the variable-speed motor 40 or the rotational speed of the brake roller 36 to thereby increase or decrease the tension of the web W. Thus, like the above-mentioned suction brake 14 and suction guide 32, the brake roller unit 34 can adjust the tension of the web W and thereby control the elongation of the web W. Consequently, the location of each band B is brought back to within the proper region CR for a cigarette C.

While in the embodiments described above, a band for decreasing a specific substance such as aldehyde is formed on the wrapping paper of a cigarette C, the wrapping paper can have bands for imparting the low ignition propensity to a cigarette. In this instance, the bands are formed at predetermined intervals along the axial direction of a cigarette, the single cigarette, therefore, has a plurality of such bands.

The invention claimed is:

1. A cigarette making machine for making cigarettes having wrapping paper, comprising:

a supply path for a web of the wrapping paper on which bands for imparting a desired property to cigarettes are previously formed at predetermined intervals along the longitudinal direction of the web, the web having elongation thereof determined by tension applied to the web, a wrapping section having a garniture tape for receiving the web from said supply path and making the web travel with cut tobacco in one direction, said wrapping section being arranged to form a tobacco rod by wrapping the cut tobacco in the web while the web is traveling, and deliver the tobacco rod formed, a cutting section for cutting the tobacco rod delivered from said wrapping section into individual cigarettes of a predetermined length, and change means for changing the location of each band relative to a cigarette while the relation between the traveling speed of the garniture tape and the timing of cutting the tobacco rod is kept constant, wherein said change means includes a brake arranged in said supply path, for adjusting tensity of the web by exerting a braking force on the web and varying elongation of the web, and a positioning device for controlling the braking force of the brake on the basis of the elongation of the web and thereby bringing the location of each band relative to a cigarette in a proper region.

2. The machine according to claim 1, wherein said positioning device includes:

a band detector arranged between the brake and the wrapping section for detecting each band on the web and sending out a detection signal, a signal generator arranged in the cutting section for sending out a cutting signal at the time the tobacco rod is cut, a determination circuit for determining whether or not each band is positioned in the proper region on the basis of the detection signal and the cutting signal, and a control circuit for adjusting the tension of the web, by means of the brake on the basis of the result of the determination by the determination circuit and thereby controlling the elongation of the web to position each band in the proper region.

3. The machine according to claim 2, wherein the proper region has a predetermined length from an ignition end of the cigarette.

4. The machine according to claim 3, wherein the brake applies tension to the web in the range of 5 to 15 N per width.

5. The machine according to claim 4, wherein the brake includes a suction brake for exerting a suction force on the web.

6. The machine according to claim 4, wherein the brake includes a brake roller unit for feeding the web in cooperation with the garniture tape.

7. The machine according to claim 4, wherein when a band located out of the proper region is detected, the control circuit increases the tension to be applied to the web by means of the brake.

8. The machine according to claim 7, wherein when a band located out of an allowable region including the proper region is detected, the control circuit sends out a removal signal for removing a cigarette having said band.

9. The machine according to claim 7, wherein when the band detector does not detect a band, the control circuit sends out a removal signal for removing a cigarette having no band.

10. The machine according to claim 4, wherein the brake previously applies tension to the web to cause predetermined elongation of the web, and the control circuit increases or decreases the tension to be applied to the web by means of the brake on the basis of the result of the determination by the determination circuit.

11. A method of making cigarettes, comprising the steps of:

supplying a web of wrapping paper on which bands are previously formed at predetermined intervals along a longitudinal direction of the web, for imparting a desired property to cigarettes the web having elongation thereof determined by tension applied to the web, receiving the web onto a garniture tape for forming a tobacco rod by wrapping cut tobacco in the web while making the web travel with the cut tobacco in one direction, and delivering the formed tobacco rod, cutting the delivered tobacco rod into individual cigarettes of a predetermined length, and changing a location of each band relative to a cigarette while the relation between the traveling speed of the garniture tape and the timing of cutting the tobacco rod is kept constant, wherein the step of changing the location of each band includes varying the elongation of the web by exerting a braking force on the web by means of a brake, and controlling the braking force of the brake on the basis of the elongation of the web and thereby bringing the location of each band relative to a cigarette in a proper region.

* * * * *